United States Patent [19]

Montague

[11] Patent Number: 4,611,190

[45] Date of Patent: Sep. 9, 1986

[54] APPARATUS FOR TRANSFORMING MULTIPHASE POWER OF DIFFERENT PHASE TO PHASE LINE LEVELS INTO MULTIPHASE POWER HAVING A SINGLE PHASE TO PHASE VOLTAGE LEVEL

[75] Inventor: Herbert R. Montague, Binghamton, N.Y.

[73] Assignee: Control Concepts Corporation, Binghamton, N.Y.

[21] Appl. No.: 709,408

[22] Filed: Mar. 6, 1985

[51] Int. Cl.[4] ..... H01F 33/00

[52] U.S. Cl. ..... 336/10; 336/147

[58] Field of Search ..... 323/361, 340; 307/17; 336/5, 10, 12, 145, 146, 147, 150

[56] References Cited

U.S. PATENT DOCUMENTS

| | | | |
|---|---|---|---|
| 1,373,910 | 4/1921 | Pressey . | |
| 1,576,280 | 3/1926 | Horelick | 336/10 X |
| 1,596,522 | 8/1926 | Fischer | 336/147 X |
| 1,896,398 | 2/1926 | Gay | 336/10 X |
| 2,020,941 | 11/1935 | Guhl | 171/119 |
| 3,706,060 | 12/1972 | Goodman | 336/147 |
| 3,939,362 | 2/1976 | Grimes et al. | 307/150 |

FOREIGN PATENT DOCUMENTS

| | | |
|---|---|---|
| 783724 | 4/1968 | Canada . |
| 355979 | 6/1931 | United Kingdom . |

*Primary Examiner*—Thomas J. Kozma

*Attorney, Agent, or Firm*—Lowe, Price, Leblanc, Becker & Shur

[57] ABSTRACT

Three-phase power susceptible of having different line to line input voltages in the wye and delta configurations is converted into a three-phase wye output, each phase of which has the same line to line voltage for all of the predetermined input voltages. A three-phase transformer has a secondary winding connected in a wye configuration. No switches are connected to the secondary winding. A primary winding of the transformer includes, for each phase, first and second coils, each having a single tap between a pair of end terminals. The terminals and taps are selectively connected in series with each other. The end terminals are selectively connected in parallel with each other. In certain of the situations all of first end terminals of first coils for each phase are connected to the line voltages. In others of the situations, predetermined first end terminals and taps of predetermined coils are connected to the line voltages and the first terminals and taps of other coils are connected to a neutral terminal.

12 Claims, 7 Drawing Figures

18
41
31
44
Φ1
12
43
46
32
120V
100V
42
45
N
60
60
47
51
54
57
208V
INPUT
120/208V
WYE
49
33
56
59
34
36
53
35
13
Φ2
52
48
55
58
14
Φ3

18
41
43
31
Φ1
12
42
220V
44
46
32
380V
45

60
57
N
INPUT
220/380V
WYE
36
53
51
58
59
54
48
34
35
49
52
55
56
13
Φ2
33
47
14
Φ3

APPARATUS FOR TRANSFORMING MULTIPHASE POWER OF DIFFERENT PHASE TO PHASE LINE LEVELS INTO MULTIPHASE POWER HAVING A SINGLE PHASE TO PHASE VOLTAGE LEVEL

TECHNICAL FIELD

The present invention relates generally to apparatus for enabling multiphase voltages having predetermined values in either the delta or wye configuration to be transformed into a single predetermined voltage in one of said configurations and more particularly to such an apparatus that includes a multiphase transformer having a secondary winding in said one configuration and a primary winding having, for each phase, a pair of coils each having a tap at a predetermined voltage division point, in combination with means for selectively connecting the coils in series and parallel configurations and for connecting end terminals of the coils and the taps to lines for each phase and to a neutral terminal.

BACKGROUND ART

Numerous systems have been developed for transforming different voltage levels in the delta and wye configurations into other voltages by the use of switch arrangements on tapped primary windings of a multiphase transformer. In general, however, these devices have been very complicated, multipurpose devices. As such, they have usually included complex switching and tap changing arrangements which are expensive and can cause reliability problems.

There is currently a need to provide a voltage transformer apparatus wherein multiphase input voltages having different levels in the delta and wye configurations are converted into a multiphase constant amplitude output voltages in one of the configurations. In the particular application of interest, it is desired to transform three-phase power susceptible of having predetermined different line to neutral and line to line input voltages in the wye and delta configurations into a three-phase wye configuration having the same line to neutral output voltage for all of the predetermined input voltages. The ratios between the line to neutral input and output voltages for the wye input voltage configurations are 120:120, 220:120, 240:120. The ratio between the line to line input and line to neutral output voltages for the delta configuration are 240:120 and 200:120. It is necessary for the apparatus to be as inexpensive as possible and to be highly reliable. As such, it is desirable for there to be constant connections between the secondary windings and the multiphase wye connected output terminals.

It is, accordingly, an object of the present invention to provide a new and improved voltage transformation apparatus wherein multiple predetermined input voltages in the delta and wye configurations are transformed into a multiphase output having a predetermined voltage for each phase, in one of said configurations.

Another object of the invention is to provide a new and improved voltage transformation apparatus for converting plural multiphase input voltages having different predetermined levels in either the delta or wye configuration into an output voltage having a predetermined value in one of the configurations, wherein the transformation apparatus is highly reliable and relatively inexpensive.

Still another object of the invention is to provide a new and improved multiphase transformer apparatus for converting multiple voltages in the delta or wye configuration into a multiphase wye output having a constant phase to neutral voltage level, wherein transformer secondary winding circuitry is maintained the same regardless of the input, thereby to improve reliability and economy.

Still another object of the invention is to provide an apparatus for inexpensively and reliably transforming wye line to neutral voltage levels in accordance with input-output of ratios 120:120, 220:120, 240:120 and for converting delta line to line voltages into a wye line to neutral voltage in accordance with the ratios 240:120 and 200:120.

BRIEF DESCRIPTION OF THE INVENTION

In accordance with one aspect of the present invention, there is provided apparatus for transforming N phase input power susceptible of having different predetermined phase to neutral voltage levels in the wye configuration and different predetermined phase voltage levels in the delta configuration into N phase output power having a single predetermined phase voltage level wherein the output is connected in one of the configurations. The transformation is reversible; N is an integer greater than two so that the invention is applicable for three-phase and higher phase systems. The apparatus comprises an N phase transformer having primary winding means and a secondary winding connected in said one configuration. Connections between the secondary winding and load terminals are fixed regardless of the amplitude or configuration of the input. The primary winding means includes a neutral terminal and, for each phase, plural coils. Each of the coils includes first and second end terminals and a single intermediate terminal to provide a predetermined voltage ratio between the end terminals thereof. The first and second coils of phase k are selectively connected in series with each other so the second end terminal of the first winding of phase k is connected to the first end terminal of the second winding of phase k. The first and second windings of phase k are selectively connected in parallel with each other so the first end terminals of the first and second windings of phase k are connected to each other and the second end terminals k are connected to each other, where k is selectively each of 1 . . . N. The second terminal of the second coil of every phase is selectively connected to the neutral terminal for the wye configuration and a first of the predetermined input voltages. A second end terminal of the second coils of one phase and the taps of the second coils of the other phases are selectively connected to the neutral terminal for the wye configuration and a second of the predetermined voltages. The end terminals of the first windings of phase k are selectively connected to at least one line for each phase. A tap of the first coil of at least one phase is selectively connected to at least one line while connecting the first end terminals of the first coil of the other phases to at least one line for other phases.

In accordance with a further aspect of the invention, the apparatus of the present invention transforms three-phase power susceptible of having different predetermined line to neutral and line to line input voltages in the wye and delta configurations into a three-phase wye configuration having the same line to neutral output voltage for all of the predetermined input voltages, wherein ratios between the line to neutral input and output voltages are 120:120, 220:120, 240:120 for the wye input voltage configurations and the ratios between the line to line input and line to neutral output voltages are 240:120 and 200:120 for the delta input voltage configurations. The different input voltage values and configurations are defined as different situations. The transformation is reversible. The apparatus for achieving this result comprises a three-phase transformer including primary winding means and a three-phase wye connected secondary winding; connections between output terminals and the secondary winding are the same regardless of the input situation. The primary winding means includes, for each phase, first and second coils. Each coil has first and second end terminals, M turns and a tap for providing a voltage division ratio of 5/6 between the end terminals. The end terminals and taps of the first and second coils of each phase are selectively in series with each other and in parallel to each other and to the line voltages and to a neutral terminal of the primary winding means. In certain of the situations all of the first end terminals of the first windings are connected to the line voltages. In others of the situations, predetermined first end terminals and taps of predetermined coils are connected to the line voltages and the first end terminals and taps of other coils to the neutral terminal.

The above and still further objects, features and advantages of the present invention will become apparent upon consideration of the following detailed description of one specific embodiment thereof, especially when taken in conjunction with the accompanying drawings.

DETAILED DESCRIPTION OF THE PREFERRED EMBODIMENT

Figure 1:
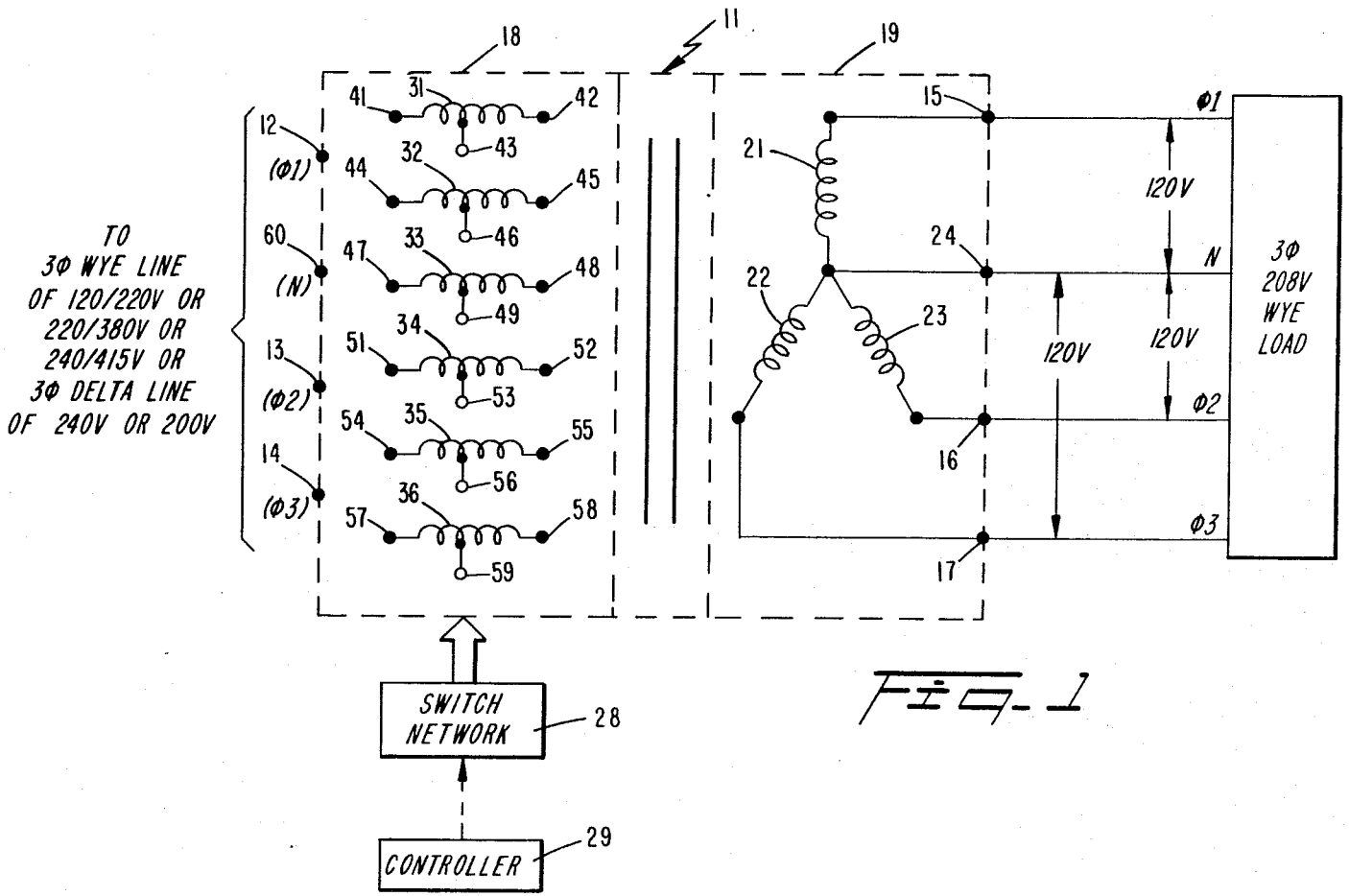
FIG. 1 is an overall schematic diagram of one embodiment of the apparatus of the present invention.

Reference is now made to FIG. 1 of the drawing wherein there is illustrated a three-phase voltage transformation device 11 having three input voltage terminals 12, 13 and 14 and three output voltage terminals 15, 16 and 17. Transformer 11 includes a three-phase primary winding circuit 18 and a three-phase wye or star connected secondary winding 19. Secondary winding 19 includes wye connected coils 21, 22 and 23, respectively having end terminals permanently connected to output terminals 15, 16 and 17. The remaining end terminals of coils 21–23 are permanently connected to neutral terminal 24, to provide the wye configuration for winding 19. The permanent connections between secondary winding 19 and output terminals 15–17 and neutral terminal 24 enhances reliability of the voltage transformation device of the present invention.

Voltages in five different situations can be connected to input terminals 12–14. In particular, the voltages applied to terminals 12–14 can be in the wye configuration, i.e., be referenced to a neutral terminal, and are susceptible of having line to neutral, line to line variations in accordance with any of: (a) 120/208, (b) 220/380, and (c) 240/415. In addition, the voltages applied to terminals 12–14 are susceptible to a delta configuration at line to line levels of 240 volts or 200 volts. Primary winding means 18 is connected to switching circuits 28 and is configured in such a way as to convert any one of these five different input voltage situations into the same output voltage configuration, viz: a three-phase wye connected output whereby there is a 120 volt phase to neutral differential and a 208 volt total line to line difference. Switch 28 is enabled to one of five different positions in response to the setting of multiposition controller 29. Alternatively, for high current applications, where switch 28 cannot handle the load, terminals 12–14 are selectively strapped by an operator to terminals of primary winding circuit 18 to achieve the connections described infra.

Broadly, for each phase, primary winding 18 includes first and second coils, each having first and second end terminals and an intermediate tap position to provide a 5/6 voltage ratio between the first and second end terminals. Thus, for the phase connected to terminal 12, coils 31 and 32 are provided, for the phase connected to terminal 13, coils 33 and 34 are provided, and for the phase connected to terminal 14, coils 35 and 36 are provided. Coil 31 includes end terminals 41 and 42 and tap 43; coil 32 includes end terminals 44 and 45 and tap 46; coil 33 includes end terminals 47 and 48 and tap 49; coil 34 includes end terminals 51 and 52 and tap 53; coil 35 includes end terminals 54 and 55 and tap 56; and coil 36 includes end terminals 57 and 58 and tap 59. Switching circuit 28 connects the various end terminals and taps to each other and to line terminals 12–14, as well as to neutral terminal 60 to provide five different configurations as illustrated in FIGS. 2–6, for primary winding circuit 18 to achieve the voltage transformation necessary for the five different input voltage situations.

In the reference numerals employed in FIGS. 1–6, the end terminal of a particular coil that is closest to the tap of that coil always has a lower reference numeral than the end terminal of the particular coil which is farther from the tap. Thus, for example, tap 43 of coil 31 is closer to end terminal 41 than to end terminal 42, so that there is a voltage division ratio of 5/6 for the ratio of the voltage from tap 43 to end terminal 42 relative to the voltage between end terminals 41 and 42. End terminals and taps 41–49 and 51–59 are interconnected with each other and to terminals 12–14 and 60 in the manner illustrated in FIGS. 2–6 and as indicated in Table I for the five different voltage configurations to be applied to terminals 12–14.

TABLE I

Figure 2:
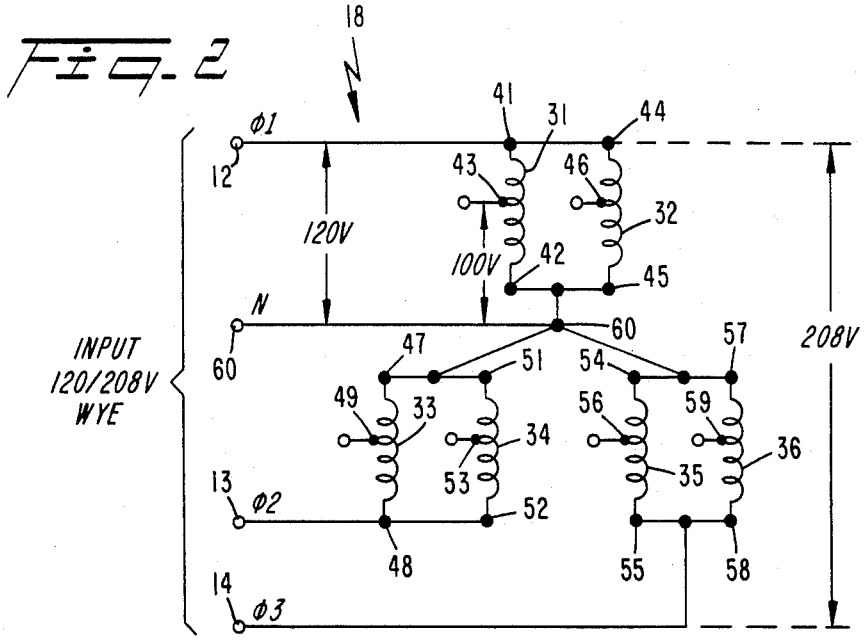
FIG. 2 is a circuit diagram of the apparatus of the present invention, when connected to convert a three-phase wye voltage having a 120 phase to neutral voltage variation into three-phase wye connected output having a 120 phase to neutral voltage.
Figure 3:
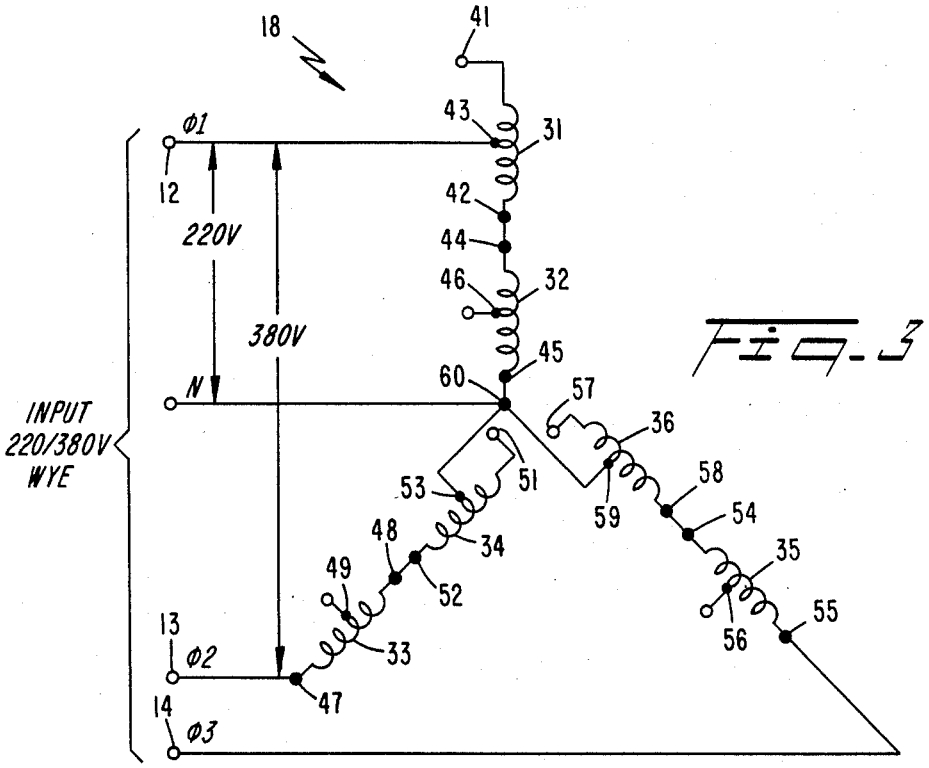
FIG. 3 is a circuit diagram of the manner in which the present invention is connected to transform 220 volt phase to neutral variations in the wye configuration into 120 volt phase to neutral variations in the wye configuration.
Figure 5:
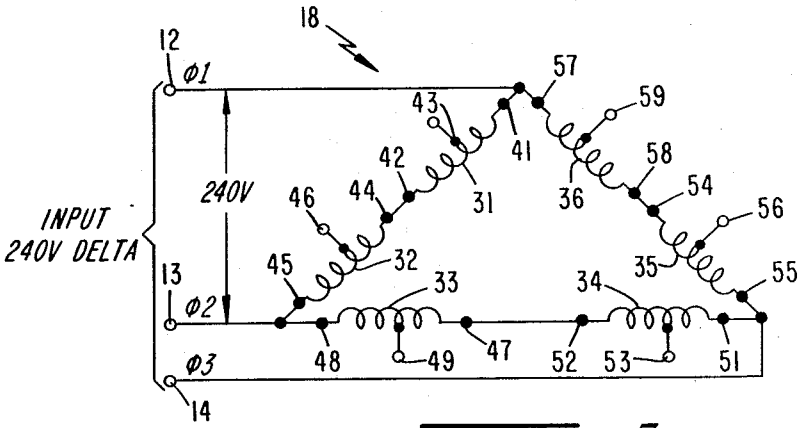
FIG. 5 is a circuit diagram of the connections of the present invention for converting a 240 volt phase to phase delta configuration into a 120 volt phase to neutral wye configuration output.
Figure 6:
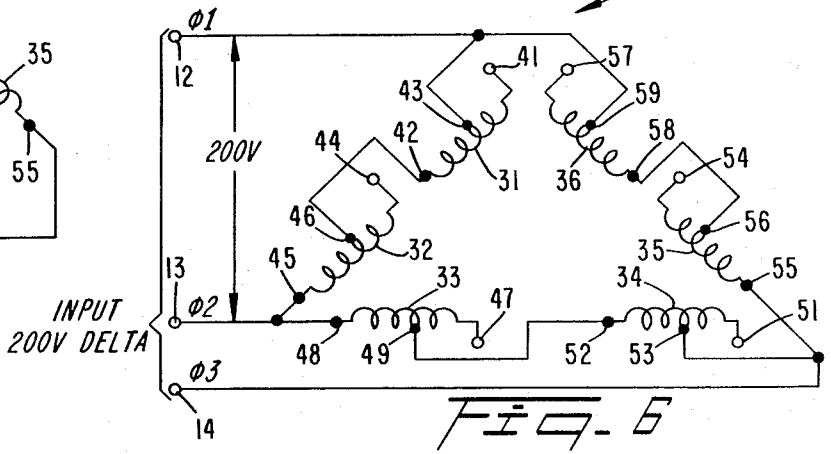
FIG. 6 is a circuit diagram of the connections for converting a 240 volt phase to phase three-phase delta configuration delta into a 120 volt phase to neutral wye connected output; a FIG. 7 a circuit diagram of switching apparatus illustrated in FIG. 1.
Figure 4:
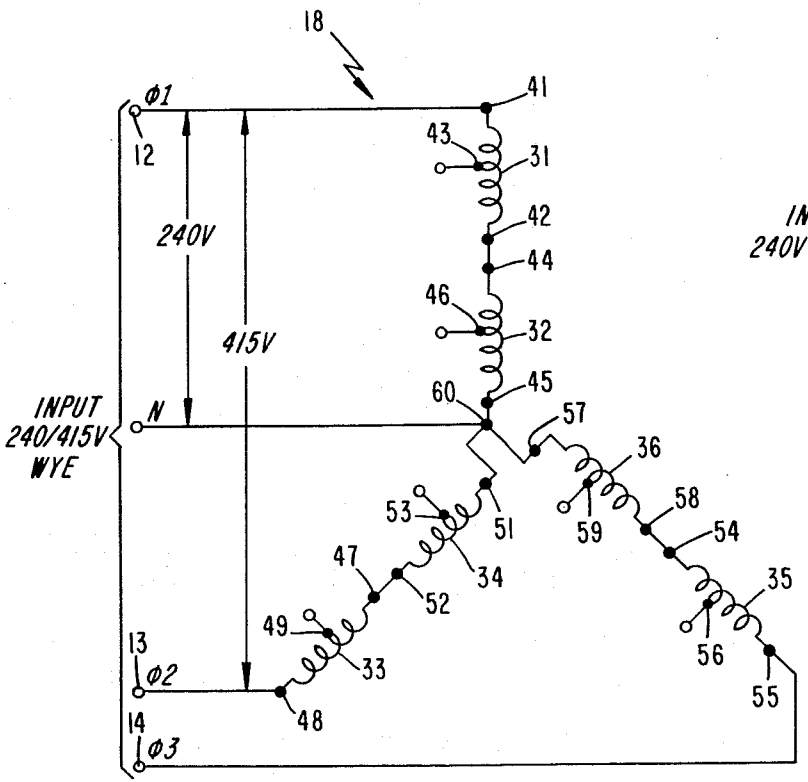
FIG. 4 is a circuit diagram of the connections of the present invention for transforming a 240 volt phase to neutral wye configuration into a 120 volt phase to neutral wye configuration.

| TERMINAL OR TAP | 120/220 V FIG. 2 | 220/380 V FIG. 3 | 240/415 V FIG. 4 | 240 V FIG. 5 | 200 V FIG. 6 |
|---|---|---|---|---|---|
| 41 | 12 | — | 12 | 12 | — |
| 42 | 60 | 44 | 44 | 44 | 46 |
| 43 | — | 12 | — | — | 12 |
| 44 | 12 | 42 | 42 | 42 | — |
| 45 | 60 | 60 | 60 | 13 | 13 |
| 46 | — | — | — | — | 42 |
| 47 | 60 | 13 | 52 | 52 | — |
| 48 | 13 | 52 | 13 | 13 | 13 |
| 49 | — | — | — | — | 52 |
| 51 | 60 | — | 60 | 14 | — |
| 52 | 13 | 48 | 47 | 47 | 49 |
| 53 | — | 60 | — | — | 14 |
| 54 | 60 | 58 | 58 | 58 | — |
| 55 | 14 | 14 | 14 | 14 | 14 |
| 56 | — | — | — | — | 58 |
| 57 | 60 | — | 60 | 12 | — |
| 58 | 14 | 54 | 54 | 54 | 56 |
| 59 | — | 60 | — | — | 12 |

To interpret Table I, each column indicates the particular voltage configuration for each of FIGS. 2–6, and each row indicates a terminal or tap. Each entry at an intersection between a column and row indicates the terminal or tap to which a particular terminal or tap assigned to that particular row is connected. For example, terminal 41 is connected in FIG. 2 to terminal 12 for phase one of a wye connected three-phase line having a 120 volt phase to a neutral variation and a phase to phase difference of 208 volts. To provide another example, terminal 55 is connected to terminal 14 in each of the wye configurations of FIGS. 2–4, namely, the 120 volt phase to neutral-208 volt phase to phase wye configuration of FIG. 2, the 220 volt phase to neutral-380 volt phase to phase wye configuration of FIG. 3, the 240 volt phase to neutral-415 volt phase to phase wye configuration of FIG. 4. As a further example, tap 59 is connected to the terminals 60 and 12 in the configurations of FIGS. 3 and 6, respectively, and is open circuited for the remaining configurations.

A study of the connections of FIGS. 2–6, as indicated by Table I, provides some interesting features which enable the present invention to achieve the desired configurations in a symmetrical manner with a minimum amount of switching, thereby making the apparatus very economical. For each of the five different configurations six terminals or taps are always unconnected. For example, in the 220/380 volt wye configuration of FIG. 3, six terminals or taps 41, 46, 49, 51, 56 and 57 are unconnected. In the 120/208 volt wye configuration of FIG. 2, six terminals 42, 45, 47, 51, 54 and 57, are connected directly to neutral line terminal 60, while two of the terminals are connected to each of phase line terminals 12, 13 and 14. In particular, terminals 41 and 44 are connected to terminal 12, terminals 48 and 52 are connected to terminal 13, while terminals 55 and 58 are connected to terminal 14. In the 220/380 volt wye configuration of FIG. 3 and the 240/415 volt wye configuration of FIG. 4, there are three connections to neutral terminal 60, namely, terminal 45, tap 53 and tap 59, and terminal 45, terminal 51 and terminal 57, respectively. There are six internal connections, in three pairs, in the configuration of FIG. 3, namely, terminals 42 and 44, terminals 48 and 52, and terminals 54 and 58. Similarly, there are six internal connections, in three pairs in the FIG. 4 configuration, viz. terminals 42 and 44, terminals 52 and 47 , and terminals 58 and 54. The identical connections between two of the three pairs in FIGS. 3 and 4 reduce the cost of the switching apparatus or minimize the number of strap changes that must be made when going from one input voltage situation to another input voltage situation.

In each of FIGS. 3 and 4, there are connections to each of phase terminals 12, 13 and 14. In the FIG. 3 configuration, tap 43 is connected to terminal 12, terminal 47 is connected to terminal 13 and terminal 55 is connected to terminal 14. Identical connections exist in the configuration of FIG. 4 between terminals 55 and 14. In addition, in FIG. 4 terminals 41 and 12 are connected together, an identical situation which exists in the configuration of FIG. 2. However, neutral terminal 60 is connected to terminals 51 and 57, instead of to taps 53 and 59.

In the 240 volt and 200 volt situations of FIGS. 5 and 6, the similar connections and symmetry again subsist. There are, in each situation two terminals or taps connected to each of phase terminals 12, 13 and 14, and six internal connections, in three pairs. In the situations of FIGS. 5 and 6, terminal 48 is connected to terminal 13, while terminal 55 is connected to terminal 14. In the 240 volt delta input situation of FIG. 5, terminals 41 and 57 are connected to terminal 12, terminals 45 and 48 are connected to termina1 13, and terminals 51 and 55 are connected to terminal 14. In the FIG. 5 configuration, internal connections subsist between terminals 42 and 44, between terminals 47 and 52, and between terminals 54 and 58. In the 200 volt delta situation of FIG. 6, terminals 43 and 59 are connected to terminal 12, terminals 45 and 48 are connected to terminal 13, and tap 53 and terminal 55 are connected to terminal 14. Internal connections subsist between terminals 42 and 46, between tap 49 and terminal 52, and between tap 56 and terminal 58.

In the situation illustrated in FIG. 2, there is a 120:120 ratio for the voltages across each phase of the primary lines 12–14 to neutral terminal 60 to the voltages across each phase of secondary lines 15–17 to neutral terminal 24 because there are n turns of each primary coil of each phase from each line voltage to the primary neutral and there are n turns of each secondary coil of each phase from the terminal of each phase of the load to the secondary neutral. In the situation illustrated in FIG. 3, there is a 220:120 ratio for the voltages across each phase of the primary lines 12–14 to neutral terminal 60 to the voltages across each phase of secondary lines 15–17 to neutral terminal 24 because there are 11n/16 turns of the series connected coils of each phase from each line voltage to the primary neutral and there are n turns of each secondary coil of each phase from the terminal of each phase of the load to the secondary neutral. In the situation illustrated in FIG. 4, there is a 240:120 ratio for the voltages across each phase of the primary lines 12–14 to neutral terminal 60 to the voltage across each phase of secondary lines 15–17 to neutral terminal 24 because there are 2n turns of the series connected coils of each phase from each line voltage to the primary neutral and there are n turns of each secondary of each phase from the terminal of each phase of the load to the secondary neutral. In the situation illustrated in FIG. 5, there is a 240:120 ratio for the voltages across each of the three-phases of the primary lines (i.e., from line 12 to line 13, from line 12 to line 14, and from line 13 to line 14) because there are 2n turns of the series coils connected between each pair of adjacent line voltage phases, and there are n turns of each secondary coil of each phase from each of secondary lines 15–17 to secondary neutral terminal 24. In the situation illustrated in FIG. 6, there is a 200:120 ratio for the voltages across each of the three phases of the primary lines (i.e., from line 12 to line 13, from line 12 to line 14, and from line 13 to line 14) because there are 5n/3 turns of the series coils connected between each pair of adjacent line voltage phases, and there are n turns of each secondary coil of each phase from each of secondary lines 15–17 to secondary neutral terminal 24.

Figure 7:
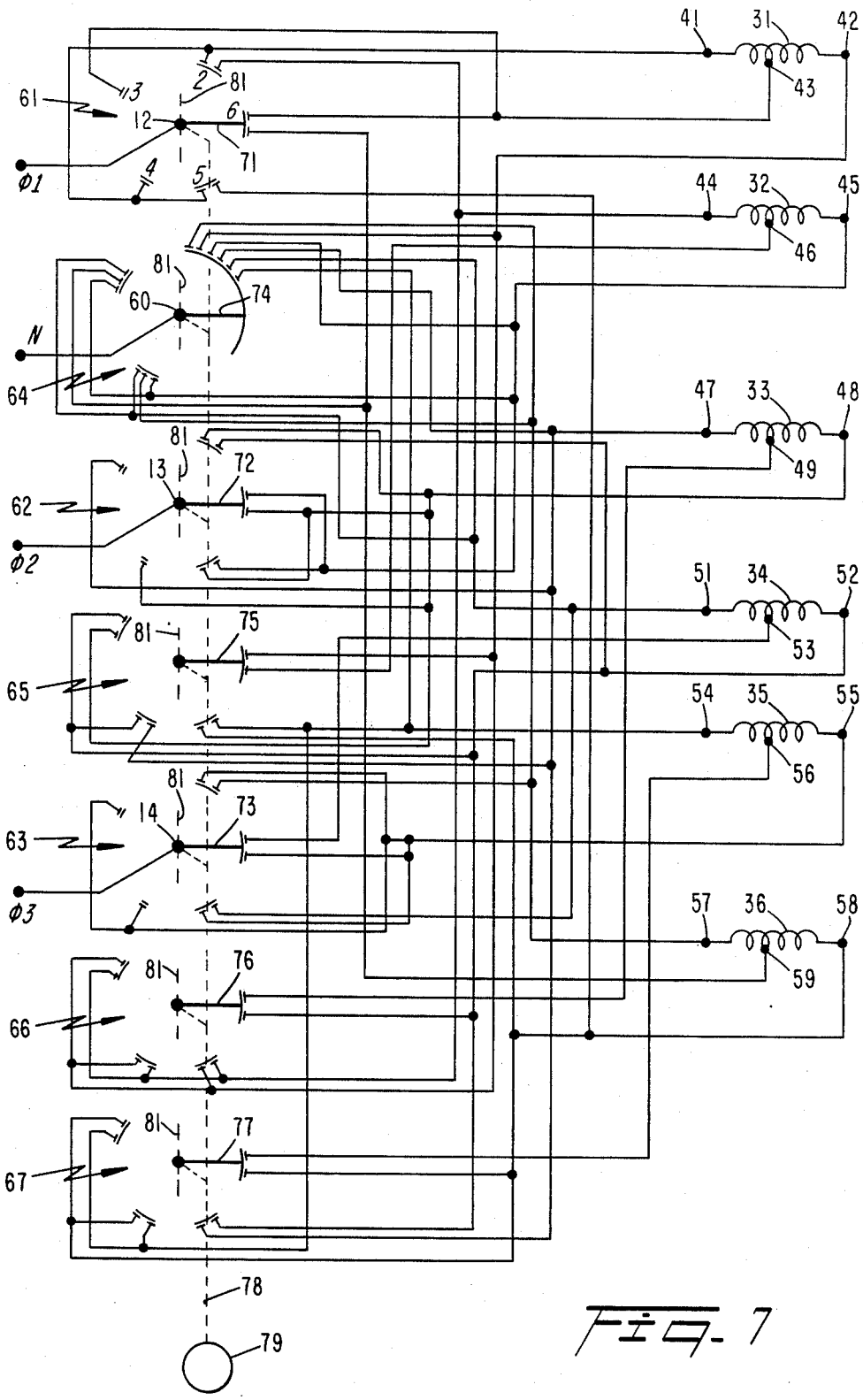

Reference is now made to FIG. 7 of the drawing, a circuit diagram of the apparatus included in switching network 28 and connections between the network and the terminals and taps of coils 31–36. Switching network 28 includes seven ganged, rotary switches 61–67, respectively including rotary armatures 71–77. Rotary armatures 71–77 are driven by a common drive shaft 78, controlled by detented knob 79; shaft 78 and knob 79 comprise controller 29, FIG. 1.

Each of switches 61–67 includes five detented, stop positions, equally spaced about a circular periphery, so that the detented stop positions are spaced from each other by 72 degrees. All of armatures 71–77 pivot about a common axis 81 so that at any instant, all of the armatures are in aligned arcuate positions. Each of armatures 71–77 includes a peripheral brush. At some stop position for switches 61–63 and 65–67 there are two terminals which are bridged, so they are electrically connected together by the respective armatures of the different switches when the armatures are at a stop position. Switch 64 includes one stop position having six terminals connected together simultaneously by the brush on armature 74, and two further positions, each having three contacts which are electrically connected together by the brush on armature 74.

Switches 61, 62 and 63 are respectively provided for phases 1, 2 and 3 of the input. Central contact terminals of armatures 71, 72 and 73 are respectively connected to terminals 12, 13 and 14. Switch 64 is provided for the neutral line of the wye configurations of FIGS. 2–4, whereby armature 74 thereof is connected to terminal 60. Switches 65–67 are for internal connections between the various terminals and taps of coils 31–36. As such, armatures 75–77 of switches 65–67 have no terminals connected thereto, except for the peripheral terminals which the switch brushes bridge when the armatures are in the stop positions.

In the switch position illustrated in FIG. 7, armatures 71–77 are positioned to provide for the 200 volt delta configuration of FIG. 6. In response to rotation of armatures 71–77 from the illustrated position in the clockwise direction, the situations associated with FIGS. 5, 4, 3 and 2 are successively encountered. The wiring between terminals and taps 41–49 and 51–59 to the peripheral terminals of switches 61–67 is as indicated in connection with Table I. The reference numerals 2–6 about the periphery of switch 61 indicate the peripheral contact stops associated with the configurations of FIGS. 2–6.

Some interesting observations concerning the switching arrangement of FIG. 7, and which lead to an economic structure for providing the switching, are noted. Except for switch 60, no more than two terminals or taps 41–49 and 51–59 are connected to any of the peripheral terminals of the switches. Thereby, the switch armatures need not have excessively high current handling capabilities. The multiple connections to the peripheral contacts of switch 64 do not require excessive current handling capacity under most circumstances because neutral currents, under most circumstances, are usually close to being balanced. The number of leads between terminals and taps 41–49 and 51–59 to the peripheral terminals of switches 61–67 is minimized because adjacent peripheral contacts of many of the switches need merely be strapped together. For example, for the configurations of FIGS. 3 and 4, the peripheral contacts of switches 66 and 67 are identical.

In operation, an operator turns knob 71 and shaft 78 to one of five positions, depending upon the situation of the three-phase line to be connected to terminals 12–14 and 60 or to terminals 12–14. Knob 71 can be mounted on the exterior of a box for the apparatus to enable the unit to be used with different line configurations by the operator. Alternatively, knob 71 can be included internally of the box and set at the time of manufacture to enable the same unit to be appropriately labelled for different expected line configurations. Regardless of the manner in which knob 79 is set, the unit is able to transform three-phase line voltages in the wye configuration, having phase to neutral and phase to phase values of 120/220 volts, 220/380 volts, and 240/415 volts into three-phase 120 volt phase to neutral, 208 volt phase to phase wye configuration. The invention is also capable of converting a three-phase 240 volt delta or a 200 delta line into a three-phase 120 volt phase to neutral, 208 volt phase to phase wye line.

While there has been described and illustrated one specific embodiment of the invention, it will be clear that variations in the details of the embodiment specifically illustrated and described may be made without departing from the true spirit and scope of the invention as defined in the appended claims.

I claim:

1. Apparatus for transforming N phase power susceptible of having different predetermined phase to neutral and phase to phase line voltage levels, in wye and delta configurations into N phase power having a single predetermined line to line voltage level in one of said configurations, the transformation being reversible, where N is an integer greater than 2, comprising an N phase transformer having primary winding means and a secondary winding connected in said one configuration, said primary winding means including a neutral terminal and P coils for each phase, where P is an integer greater than 1, each of said coils including first and second end terminals and a single intermediate tap, the intermediate tap on each coil being at the same predetermined point along the coil, and means for: (a) selectively connecting said coils of phase k in series with each other so the second end terminal of a first coil of phase k is connected to the first end terminal of the P coil of phase k and for selectively connecting the P coils of phase k in parallel with each other so the first end terminals of the P coils of phase k are connected to each other and the second end terminals of the P coils of phase k are connected to each other, where k is selectively every one of 1 . . . N, and (b) selectively connecting the second terminal of the P coil of every phase to the neutral terminal for the wye configuration and a first of the predetermined voltages, and (c) selectively connecting a second end terminal of the P coil of one phase and the taps of the P coil of other phases to the neutral terminal for the wye configuration and a second of the predetermined voltages, and (d) selectively connecting the end terminals of the first coil of phase k to at least one line for each phase, and (e) selectively connecting a tap of the first coil of at least one phase to at least one line while connecting the first end terminals of the first coil of other phases to at least one line for other phases.

2. The apparatus of claim 1 wherein P=2.

3. The apparatus of claim 1 wherein N=3 and P=2.

4. The apparatus of claim 1 further including a load terminal for each phase, the secondary winding including an output terminal for each phase, the output terminals of the secondary winding being permanently connected without switches to the load terminals.

5. Apparatus for transforming three-phase power susceptible of having predetermined different line to line input voltages in the wye and delta configurations into a three-phase wye configuration having the same line to line output voltage for all of the predetermined input voltages, the ratios between the line to neutral input and output voltages being 120:120, 220:120, 240:120 for the wye input voltage configuratons, the ratios between the line to line input and output voltages being 240:120 and 200:120 for the delta input voltage configurations, the different voltage values and configurations being defined as different situations, the transformation being reversible, comprising a three-phase transformer including primary winding means and secondary winding means, the secondary winding means including three coils each having n turns and connected in a wye configuration, the primary winding having, for each phase, first and second coils each having first and second end terminals, n turns and a tap between the first and second end terminals to provide a 5/6 voltage division factor, and means for selectively connecting one end terminals and taps of the first and second coils of each phase in series with each other and in parallel to each other and to the line voltages and to a neutral terminal of the primary winding means so that in certain of said situations all of the first end terminals of the first coils are connected to the line voltages, and in others of said situations predetermined coils of the primary winding means are connected to the line voltages and the first end terminals and taps of other coils of the primary winding means are connected to the neutral terminal.

6. The apparatus of claim 5 further including a load terminal for each phase, the secondary winding including an output terminal for each phase, the output terminals of the secondary winding being permanently connected without switches to the load terminals.

7. The apparatus of claim 5 wherein for the 120:120 situation: the first end terminals of the coils of phase k are connected to each other and to the line for phase k, and second end terminals of the coils of phase k are connected to each and to the neutral terminal of the primary winding means, where k is selectively each of 1, 2 and 3.

8. The apparatus of claim 5 wherein for the 220:120 situation the end terminals and taps of the first and second coils of phase k are series connected such that there are 11n/6 turns between each line voltage and the neutral terminal.

9. The apparatus of claim 5 wherein for the 240:120 wye input situation the end terminals of the first and second coils of each phase are series connected so there are 2n turns between each line voltage and the neutral terminal.

10. The apparatus of claim 5 wherein for the 240:120 delta input situation the end terminals of the first and second coils of phase k are series connected so there are 2n turns between the line voltages of each of phases 1 and 2, 2 and 3, and 1 and 3.

11. The apparatus of claim 5 wherein for the 200:120 situation the end terminals and taps of the first and second coils of phase k are series connected together so there are 5n/3 turns between the line voltages of each of phases 1 and 2, 2 and 3, and 1 and 3.

12. The apparatus of claim 5 wherein: for the 120:120 situation the first end terminals of the coils of phase k are connected to each other and to the line for phase k, second end terminals of the coils of phase k are connected to each other and to the neutral terminal of the primary winding means, where k is selectively each of 1, 2 and 3; for the 220:120 situation the end terminals and taps of the first and second coils of phase k are series connected such that there are 11n/6 turns between each line voltage and the neutral terminal; for the 240:120 wye input situation the end terminals of the first and second coils of each phase are series connected so there are 2n turns between each line voltage and the neutral terminal; for the 240:120 delta input situation the end terminals of the first and second coils of phase k are series connected so there are 2n turns between the line voltages of each of phases 1 and 2, 2 and 3, and 1 and 3; for the 200:120 situation the end terminals and taps of the first and second coils of phase k are series connected together so there are 5n turns between the line voltages of each of phases 1 and 2, 2 and 3, and 3 and 1.

* * * * *